US005790680A

United States Patent [19]

Sood

[11] Patent Number: 5,790,680

[45] Date of Patent: Aug. 4, 1998

[54] MICROPHONE-HOLDING DECORATIVE PIN

[76] Inventor: Kathryn C. Sood, 79 Middleton Rd., Boxford, Mass. 01921

[21] Appl. No.: 866,945

[22] Filed: May 31, 1997

[51] Int. Cl.[6] ..... H04R 25/00

[52] U.S. Cl. ..... 381/169; 381/168

[58] Field of Search ..... 381/168, 169, 381/68, 113, 111, 69; 379/430, 431; 63/20

[56] References Cited

U.S. PATENT DOCUMENTS

| | | | |
|---|---|---|---|
| 2,505,551 | 4/1950 | Knowles | 381/169 |
| 2,616,985 | 11/1952 | Levy | 381/169 |
| 3,743,784 | 7/1973 | Sato | 381/113 |
| 3,864,531 | 2/1975 | Watson | 381/111 |
| 4,088,848 | 5/1978 | Weed . | |
| 4,410,772 | 10/1983 | Sato | 381/169 |
| 5,299,434 | 4/1994 | Kaufman . | |
| 5,303,305 | 4/1994 | Raimo et al. | 381/68 |
| 5,389,917 | 2/1995 | La Manna et al. . | |
| 5,455,869 | 10/1995 | Miscavige . | |
| 5,677,948 | 10/1997 | Meister | 379/142 |

FOREIGN PATENT DOCUMENTS

| | | | |
|---|---|---|---|
| 61-105196 | 5/1986 | Japan | 381/169 |

*Primary Examiner*—Sinh Tran
*Attorney, Agent, or Firm*—Don Halgren

[57] ABSTRACT

The present invention relates to a microphone holding decorative pin assembly for the holding of one or more miniature microphones and for providing an attractive holding pin assembly. The pin assembly comprises a panel having a front surface for a decorative pin display for a wearer thereof. The panel has a rear surface with a first and a second securement arrangement thereon. The first securement means comprises a pivotable pin arranged between a pair of standoffs extending from the rear surface of the panel. The second securement means comprises a biased paddle hingedly attached to a base on the rear surface, the paddle having a angled frame so as to permit the paddle to secure a plurality of microphones wires in a uniform manner. The paddle and the base each define a plane which are parallel to one another to prevent pinching of any microphone wires between the paddle and the base.

6 Claims, 1 Drawing Sheet

MICROPHONE-HOLDING DECORATIVE PIN

BACKGROUND OF THE INVENTION

1. Field of the Invention

This invention relates to functional jewelry and more particularly to a decorative pin for securely holding one or more miniature microphones.

2. Prior Art

Microphones are to be utilized in the recording and amplification of voices or musical instruments. Typically the microphone should be held as close to the source of the sound as possible without having any interference whether the user's hands or his/her ability to perform. A further requirement is that the microphone be free of its own sound interfering input. That is, the microphone should be held away from rubbing against a person, his/her arms, hands, or clothing.

There have been attempts in this field to provide microphone holding arrangements. Such as may be seen in U.S. Pat. No. 5,455,869 to Niscavige for a lapel microphone assembly. This device is a shell-shaped enclosure which limits the size of the microphone that it is able to hold, and it is not particularly attractive to wear.

A further lapel microphone arrangement is shown in U.S. Pat. No. 5,389,917 to LaManna et al. showing a data entry terminal. This arrangement is merely functional, having no decorative component, nor having any independent microphone holding arrangement. A further approach, to holding items against one's clothing, is shown in U.S. Pat. No. 5,299,434 to Kaufman, wherein an ornamental broach has a pocket in which to carry a condom, and advertise a safe sex message.

A further patent for showing a microphone holding device is that in U.S. Pat. No. 4,088,848 to Weed wherein a carrying device is shown for holding a microphone against a wall. This device however is neither wearable nor decorative, and is cited as typical of the art.

It is an object of the present invention, to provide a decorative broach or pin, which permits the comfortable holding of at least one or more microphones in a comfortable and safe manner with a decorative and attractive pin or broach providing the frame for that holding apparatus.

It is a further object of one embodiment of the present invention, to provide a pin or broach, which will hold at least a portion of a microphone in an upright and proper manner behind a decorative pin or broach.

It is a yet still further object of the present invention, to provide an arrangement for holding a microphone in a decorative and functional manner close enough to a speaker, yet far enough away from the speaker's clothing so as not to provide any interfering noise.

It is yet still a further object of the present invention, to provide a decorative and functional broach or pin for holding a microphone, which will accommodate a wide variety of microphones, regardless of their particular configuration or connecting wire.

BRIEF SUMMARY OF THE INVENTION

The present invention comprises a microphone holding decorative pin or broach for holding one or more lapel-type microphones close to the speaker in a decorative and functional manner. The microphones are of the miniature type and may be characterized as lapel or lavalier, as known in the art.

The microphone holding decorative broach or pin of the present invention comprises a first or forwardly facing panel having a front or decorative surface thereon. The panel comprising the decorative broach or pin has a second or rearward facing surface which is facing the clothing of the wearer. A first and a second standoff is disposed on the second or rearward facing surface of the broach or pin panel. The first and second standoffs are spaced apart at least approximately one and one quarter inches. The first standoff has a pivotable pin attached thereto, through a hinge or axis arranged with the standoff. The second spaced apart standoff includes a lock bolt engagement means so as to receive the distal end of the pin from the first standoff. The lockable engagement means comprises a moveable sleeve which grasps the distal end of the pin and secures it within a slot of the standoff.

The spaced apart first and second standoffs with their first attachment means is arranged to secure the microphone holding decorative pin or broach to the wearer's article of clothing.

A second attachment means is arranged on the second or rearward side of the panel comprising the microphone holding decorative panel broach. The second attachment means is disposed above and spaced apart from the first attachment means as the holder pin assembly would be normally worn by a wearer thereof.

The second attachment means comprises a generally rectangular panel attached adjacent the second or rearward side of the microphone holding decorative broach or pin. The decorative panel has a first edge which includes a hinge. The second attachment means includes a swingable paddle having a first end which is attached to the hinge. The first end of the paddle includes an angled frame portion supporting a distal rectangular paddle portion thereon. The paddle portion and its supported angled frame portion is shaped in a critical manner, so as to permit the plane of the rectangular swingable paddle shaped portion to be parallel to the plane of the rectangular panel base of the second attachment means as its is in its securement orientation. The frame portion of the swingable paddle also has a biasing arrangement thereon such as a spring or biased tab which engages the first planar member, so as to bias the paddle portion in a direction towards the rectangular base of the second attachment means. By requiring the parallelism between the rectangular paddle portion and the base component of the second attachment means, more than one microphone is permitted to be supported by the decorative microphone holding pin or broach.

In yet a further embodiment of the present invention, there is contemplated a conical depression adjacent the uppermost edge of the planar base of the second attachment means. The conical depression provides an arcuate gripping element to the base portion of any miniature microphone which may be captured between the paddle portion and the base plate of the second engagement means.

Thus, in addition to the ability to hold more than one microphone, the present microphone holding decorative pin or broach may also help align the microphone in a spaced apart manner from the clothing of the wearer of the decorative microphone holding pin assembly.

Thus what has been shown is a unique functional and decorative microphone holding pin or broach having a rearside for the securement of one or more microphones thereto, and for securement of the pin assembly to the clothing of a wearer of the pin assembly, the pin assembly also having a front side which permits a slogan, sign, or decorative emblem to be placed on the pin or broach while simultaneously supporting one or more lapel-type microphones in a spaced apart and proper manner.

The invention thus comprises a microphone holding decorative pin assembly for the holding of one or more miniature microphones and for providing an attractive holding pin assembly. The assembly comprises a panel having a front surface for a decorative pin display for a wearer thereof. The panel has a rear surface with a first and a second securement arrangement thereon. The first securement means comprises a pivotable pin arranged between a pair of standoffs extending from the rear surface of the panel. The second securement means comprises a biased paddle hingedly attached to a base on the rear surface, the paddle having an angled frame so as to permit the paddle to secure a plurality of microphones wires in a uniform manner, the paddle and the base each defining a plane which are parallel to one another to prevent pinching of any of the microphone wires between the paddle and the base. The angled frame is arranged to slide upon the base so as to bias the paddle into a closed position when the paddle and the base have a microphone wire engaged therebetween. The microphone holding decorative pin assembly includes a conical depression arranged in the surface of the base so as to permit a miniature microphone to be supportively and alignably secured between the paddle and the base. The second securement means is spacedly arranged so as to support a microphone wire and microphone away from an article of clothing to which the first securement means is fixedly secured. The second securement means is arranged closer to the panel than the first securement means so as to provide such spaced support of the microphone wires from a wearer of the decorative pin.

The invention includes a method of holding one or more miniature microphones and for providing an attractive holding pin assembly on a wearer of the pin assembly, comprising the steps of: providing a panel having a front surface for a decorative pin display for a wearer thereof, the panel having a rear surface having a first and a second securement arrangement thereon; arranging the first securement means comprising a pivotable pin arranged between a pair of standoffs extending from the rear surface of the panel, and wherein the second securement means comprises a biased paddle hingedly attached to a base on the rear surface, the paddle having a angled frame so as to permit the paddle to secure a plurality of microphones wires in a uniform manner, the paddle and the base each defining a plane which are parallel to one another to prevent pinching of any of the microphone wires between the paddle and the base.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
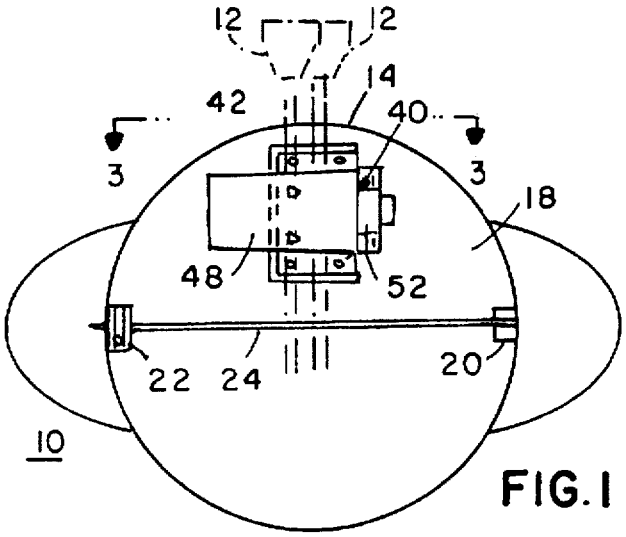
FIG. 1 is an elevational view of the second or rear facing side of a microphone holding decorative pin or broach constructed according to the principles of the present invention.

Referring now to the drawings in detail, and particularly to FIG. 1, there is shown a microphone holding decorative pin or broach assembly 10 for holding one or more lapel-type microphones 12, (shown in phantom in FIGS. 1 and 4), close to the speaker (wearer of the pin/broach assembly) in a decorative and functional manner. The microphones are of the miniature type and may be characterized as lapel or lavalier, as known in the art.

The microphone holding decorative broach or pin 10 of the present invention comprises a first or primary panel 14 having a front or decorative surface 16 thereon. The panel 14 comprising the decorative broach or pin 10 has a second or rearward facing surface 18 which would face the clothing of the wearer. A first and a second standoff 20 and 22 are disposed on the second or rearward facing surface 18 of the broach or pin panel 14. The first and second standoffs 20 and 22 are spaced apart at least approximately one and one quarter inches. The first standoff 20 has a pivotable pin 24 attachment means attached thereto, through a hinge or axis 26 arranged with the standoff 20: The second spaced apart standoff 22 includes a lock bolt engagement means 28 so as to receive the distal end of the pin 24 from the first standoff 20. The lockable engagement means 28 comprises a moveable sleeve 30 which grasps the distal end of the pin 24 and secures it within a slot 34 of the standoff 22 in a known manner.

The spaced apart first and second standoffs 20 and 22 with their first attachment means 24 is arranged to secure the microphone holding decorative pin or broach 10 to the wearer's article of clothing.

A second attachment means 40 is arranged on the second or rearward side 18 of the panel 14 comprising the microphone holding decorative panel broach 10. The second attachment means 40 is disposed above and spaced parallel and apart from the first attachment means 24 as the holder pin assembly 10 would be normally worn by a wearer thereof.

Figure 2:
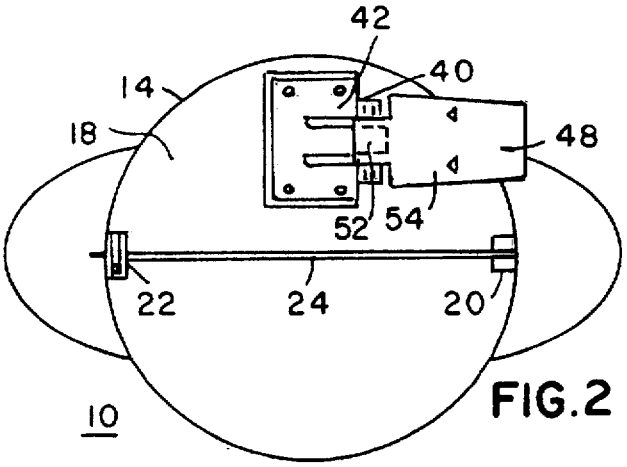
FIG. 2 is a view similar to FIG. 1, wherein an attachment means is shown in its open configuration.
Figure 3:
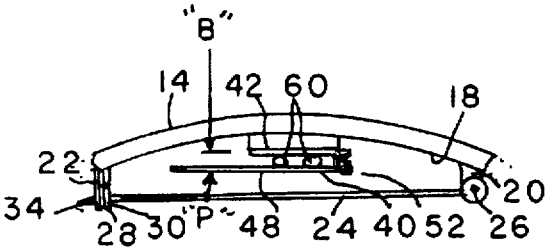
FIG. 3 is a partial sectional view taken along the lines 3—3 of FIG. 1.

The second attachment means 40 comprises a generally rectangular panel 42 attached adjacent the second or rearward side 18 of the microphone holding decorative broach or pin 10, as may be seen in FIGS. 1 and 2. The panel 42 has a first edge 44 which includes a hinge 46. The second attachment means 40 also includes a swingable paddle 48 having a first end 50 which is attached to the hinge 46. The first end 50 of the swingable paddle 48 includes an angled frame portion 52 supporting a distal rectangular paddle portion 54 thereon. The paddle portion 54 and its supported angled frame portion 52 is shaped in a critical manner, so as to permit the plane "P" of the rectangular swingable paddle portion 54 to be parallel to the plane "B" of the rectangular panel 42 comprising the base of the second attachment means 40 as its is in its securement orientation. The frame portion 52 of the swingable paddle 48 also has a biasing arrangement 56 thereon such as a spring or biased tab which engages the first planar member 42, so as to bias the paddle portion 48 in a direction towards the rectangular base 42 of the second attachment means 40. By requiring the parallelism between the rectangular paddle portion 48 and the base component 42 of the second attachment means 40, more than one microphone is permitted to be supported by the decorative microphone holding pin or broach 10, as may be seen by a plurality of microphone wires 60 being shown in FIG. 3.

Figure 4:
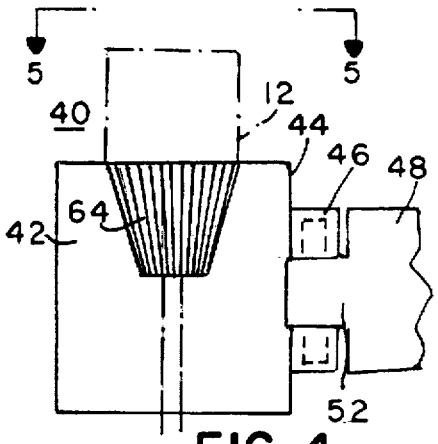
FIG. 4 is an enlarged view of a portion of the second attachment means in a further embodiment thereof.
Figure 5:
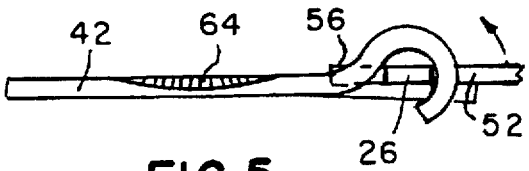
FIG. 5 is a view taken along the lines 5—5 of FIG. 4.

In yet a further embodiment of the present invention, there is contemplated a conical depression 64, adjacent the uppermost edge 66 of the planar base 42 of the second attachment means 40, as may be seen in FIG. 4. The conical depression 64 provides an arcuate gripping element to the base portion of any miniature microphone 12 which may be captured between the paddle portion 48 and the base plate 42 of the second engagement means 40.

Thus, in addition to the ability to hold more than one microphone 12, the present microphone holding decorative pin or broach 10 may also help align the microphone 12 in a spaced apart manner from the clothing of the wearer of the decorative microphone holding pin assembly 10.

Thus what has been shown is a unique functional and decorative microphone holding pin or broach having a rearside for the securement of one or more microphones thereto, and for securement of the pin assembly to the clothing of a wearer of the pin assembly, the pin assembly also having a front side which permits a slogan, sign, or decorative emblem to be placed on the pin or broach while simultaneously supporting one or more lapel-type microphones in a spaced apart and proper manner.

I claim:

1. A microphone holding decorative pin assembly for the holding of one or more miniature microphones and their wires and for providing an attractive holding pin assembly, comprising:

a panel having a front surface for a decorative pin display for a wearer thereof, said panel having a rear surface having a first and a second securement arrangement thereon;

said first securement means comprising a pivotable pin arranged between a pair of standoffs extending from said rear surface of said panel; and said second securement means comprising a biased planar paddle hingedly attached to a planar base on said rear surface, said planar paddle having a supportive frame angled with respect to said planar paddle and supporting said paddle on said hinge, said planar paddle and said base thereby each defining a plane which are parallel to one another to permit uniform pressure and snug uniform holding of said microphone wires between said paddle and said base to permit said paddle to secure a plurality of microphones and wires in a uniform manner.

2. The microphone holding decorative pin assembly as recited in claim 1, including an extension on said angled frame arranged to slide upon said base so as to bias said paddle into a closed position when said paddle and said base have a microphone wire engaged therebetween.

3. The microphone holding decorative pin assembly as recited in claim 2, including a conical depression arranged in the surface of said base so as to permit a miniature microphone to be supportively and alignably secured between said paddle and said base.

4. The microphone holding decorative pin assembly as recited in claim 3, wherein said second securement means is spacedly arranged so as to support a microphone wire and microphone away from an article of clothing to which said first securement means is fixedly secured.

5. The microphone holding decorative pin assembly as recited in claim 4, wherein said second securement means is arranged closer to said panel than said first securement means so as to provide such spaced support of said microphone wires from a wearer of said decorative pin.

6. A method of holding one or more miniature microphones and for providing an attractive holding pin assembly on a wearer of said pin assembly, comprising the steps of:

providing a panel having a front surface for a decorative pin display for a wearer thereof, said panel having a rear surface having a first and a second securement arrangement thereon;

arranging said first securement means comprising a pivotable pin arranged between a pair of standoffs extending from said rear surface of said panel; and wherein said second securement means comprises a biased paddle hingedly attached to a base on said rear surface of said panel; and wherein said second securement means comprises a planar base on said rear surface of said pin assembly having a hinge on one edge thereof, and a planar paddle attached to said hinge by a frame member arranged at an angle with respect to said planar paddle, said planar paddle and said planar base thereby each defining a plane which are parallel to one another to permit uniform pressure and thus secure holding of more than one microphone and wire between said paddle and said base.

* * * * *